US007481231B2

(12) United States Patent
Litterst et al.

(10) Patent No.: US 7,481,231 B2
(45) Date of Patent: Jan. 27, 2009

(54) WARE WASHING INSTALLATION

(75) Inventors: Juêrgen Litterst, Appenweier (DE); Udo Erb, Lahr (DE)

(73) Assignee: Premark FEG L.L.C., Wilmington, DE (US)

( * ) Notice: Subject to any disclaimer, the term of this patent is extended or adjusted under 35 U.S.C. 154(b) by 678 days.

(21) Appl. No.: 11/225,982

(22) Filed: Sep. 14, 2005

(65) Prior Publication Data

US 2006/0060231 A1 Mar. 23, 2006

(30) Foreign Application Priority Data

Sep. 18, 2004 (DE) ..... 10 2004 045 445

(51) Int. Cl.
*B08B 3/02* (2006.01)

(52) U.S. Cl. ..... 134/60; 134/72; 134/111; 134/131

(58) Field of Classification Search ..... 134/60, 134/72, 111, 131
See application file for complete search history.

(56) References Cited

U.S. PATENT DOCUMENTS 3,504,390 A * 4/1970 Wing ..... 15/56
3,598,131 A * 8/1971 Weihe, Jr. ..... 134/107
3,789,860 A * 2/1974 Katterheinrich et al. ..... 165/47
3,849,197 A * 11/1974 Sorrentino ..... 134/10
3,896,828 A * 7/1975 Foster et al. ..... 134/57 R
3,906,895 A * 9/1975 Morino et al. ..... 118/326
4,039,349 A * 8/1977 Kwasnoski et al. ..... 134/10

FOREIGN PATENT DOCUMENTS

| | | | |
|---|---|---|---|
| DE | 1766212 | | 5/1958 |
| DE | 1956050 | | 5/1971 |
| DE | 44 37 737 | * | 4/1996 |
| DE | 296 22 760 | * | 8/1997 |
| DE | 19829650 | | 1/2000 |
| RU | 2150228 | | 6/2000 |

OTHER PUBLICATIONS

European Patent Office 0 036 217 Sep. 1991.*

* cited by examiner

*Primary Examiner*—Frankie L Stinson
(74) *Attorney, Agent, or Firm*—Thompson Hine LLP

(57) ABSTRACT

Ware washing installation, containing at least one conveyor-type ware washer. The conveyor-type ware washer contains at least one wash zone (8, 10, 12) with spray nozzles (20, 28), a first rinse zone (14) with spray nozzles (21, 29) and a final rinse zone (16) with spray nozzles (23, 31). Additional spray nozzles (22, 30) are arranged between the spray nozzles (21, 29) of the first rinse zone (14) and the spray nozzles (23, 31) of the final rinse zone (16). Rinse water which is pre-used and then filtered through a microfiltration device or a ultrafiltration device (58) is supplied to the additional spray nozzles (22, 30).

10 Claims, 2 Drawing Sheets

WARE WASHING INSTALLATION

Figure 1:
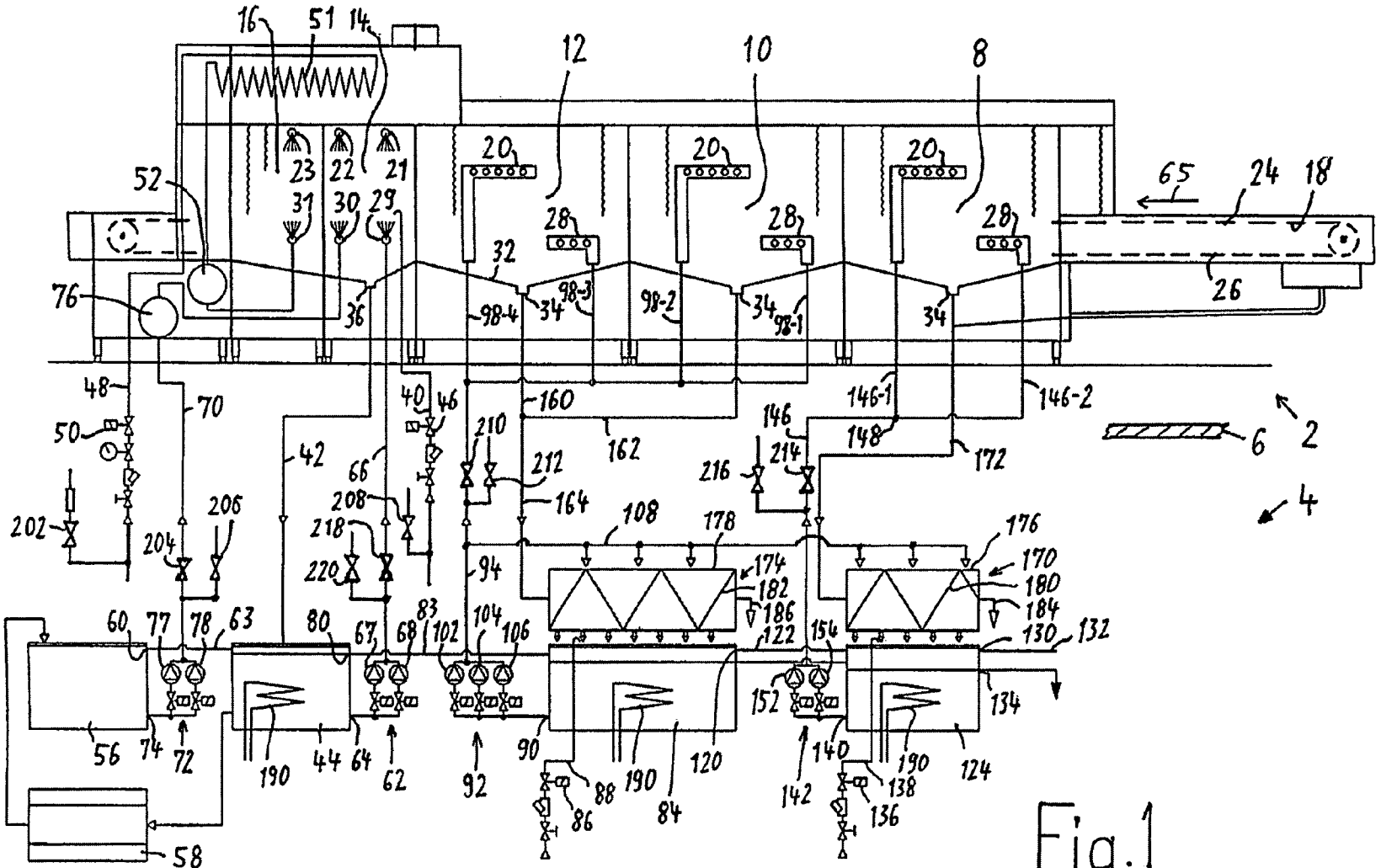

The invention relates to a ware washing installation, containing at least one conveyor-type ware washer, preferably a flight-type ware washer or a rack-conveyor ware washer, according to the preamble of claim 1.

Conveyor-type ware washers according to the prior art contain a ware cleaning device and recirculation circuits with elements for water heating and/or for water purification and/or for the intermixing of various water streams, in order thereby to refresh more heavily contaminated water with less heavily contaminated water.

A ware washer is shown, for example, in the publication of an Abstract of Invention of Russian Patent RU 2 150 228 C1.

There are two types of conveyor-type ware washers. One type is flight-type ware washers, in which the conveyor belt has holding elements for holding the ware to be cleaned. The other type is rack-conveyor ware washers, in which a conveyor mechanism transports racks which contain the ware. In all types of machine, the conveyor belt or the conveyor mechanism is provided with a multiplicity of interspaces or passage orifices, through which water sprayed onto the ware can run off downwards.

Ware washers are suitable not only for the cleaning of ware in the form of plates, cups and bowls, but also for the cleaning of ware in the form of spoons, knives and forks and for the cleaning of trays and also for the cleaning of other articles used in catering establishments, in particular in hotels, restaurants and canteens. Within the scope of the present description, therefore, the expression "ware" is used to represent all articles which can normally be cleaned by means of a ware washer, in order to simplify the description of the invention.

The invention is to achieve the object of designing a ware washing installation which contains at least one conveyor-type ware washer, in such a way that the process of cleaning the ware becomes more independent of the provision of water for the cleaning operation.

This object is achieved, according to the invention, by means of the features of claim 1.

Advantage of the invention: Reduction of the consumption of tap water and improved cleaning.

According to a special embodiment of the invention, the invention relates to a ware washing installation, containing at least one conveyor-type ware washer, preferably a flight-type ware washer or a rack-conveyor ware washer, characterized in that the at least one conveyor-type ware washer is divided into a ware cleaning appliance and a water treatment station arranged spatially separately from the latter, and in that at least one recirculation circuit is formed, in which water is recirculated from the water treatment station to the ware cleaning appliance and back again, the recirculation circuit having, in the ware cleaning appliance, spray nozzles for the spraying of water onto the ware and at least one water discharge orifice for the recirculation of sprayed water back to the water treatment station.

Advantages of the special embodiment: the water can be treated separately from the ware cleaning appliance, for example purified, heated, conveyed by pumps and/or varied by the intermixing of water of different quality and/or by the intermixing of water with other liquids or with additives.

Further features and advantages may be gathered from the following description of the invention and from the patent claims. All the features of the invention which are described above and below can be utilized individually and in part combination in order to form further machine variants.

The water treatment station preferably contains a screening device and/or a diaphragm-filter device. According to a particular embodiment of the invention, the ware cleaning appliance contains a plurality of, for example two cleaning zones, the water treatment station having a screening device for the first cleaning (washing) zone and a diaphragm-filter device for the second cleaning (rinse) zone.

According to a likewise preferred embodiment of the invention, the screening device has a rotating screening cylinder, through which the water is conducted, and a solids discharge device is arranged inside the screening cylinder for the discharge of solids (soil) from the water.

Figure 2:
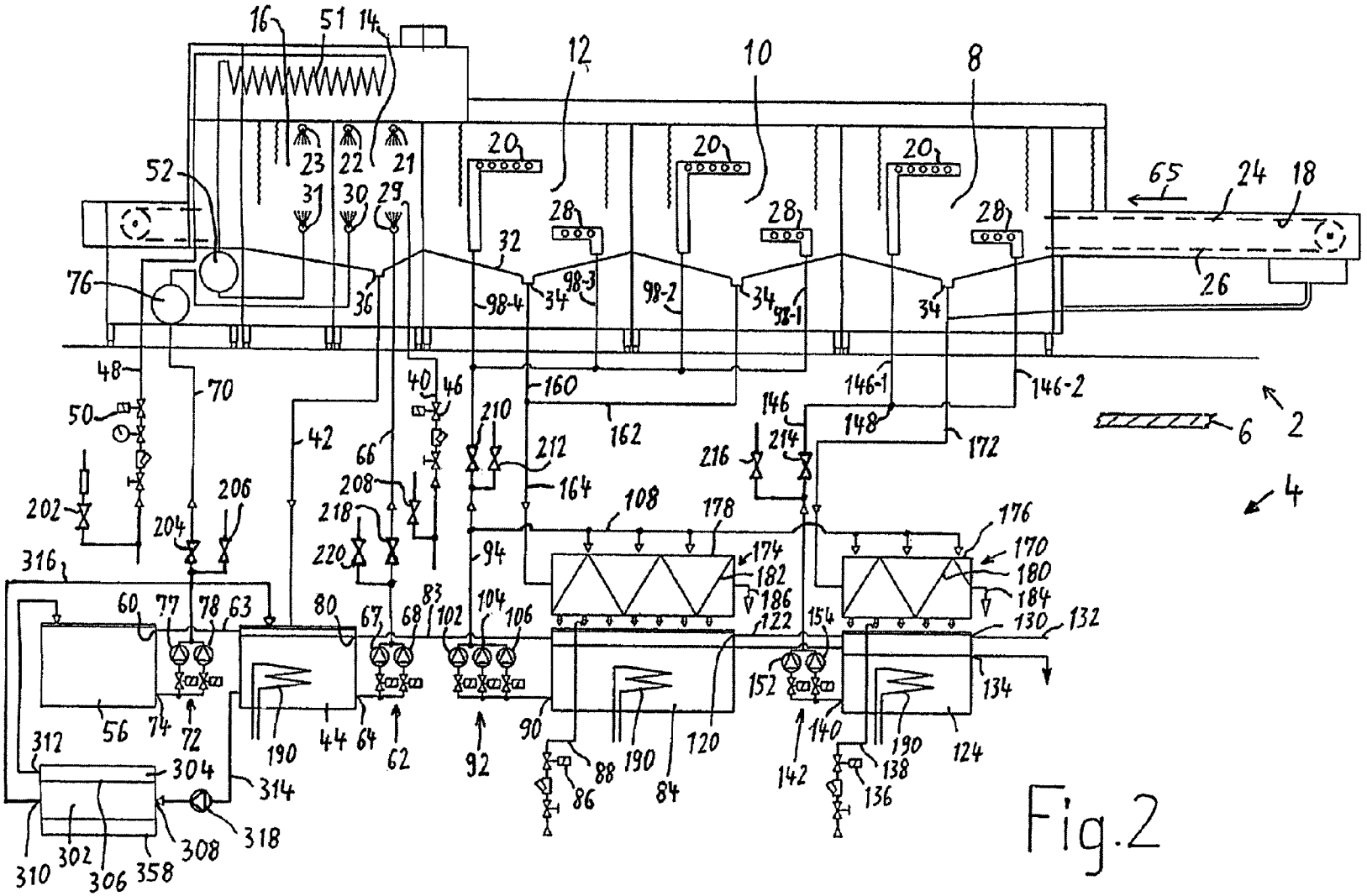

The invention is described below by means of preferred exemplary embodiments, with reference to the accompanying drawings in which:

FIG. 1 shows diagrammatically a ware washing installation according to the invention, without the invention being restricted to the illustrated number of individual elements, regions or zones, FIG. 2 shows a second embodiment of the invention in which elements which are identical or similar to elements of FIG. 1 are provided with the same reference number.

The water treatment station described below may be designed in various ways for one or more or all of the functions described below, such as, in particular, the purification of the water flowing out of the at least one ware cleaning appliance by filtering, screening, flushing-out and/or mechanical discharge of solids and other impurities from the water and/or the partial removal of dirty water and/or the dilution of dirty water with fresh water or with less heavily contaminated water already used, and/or the heating of the water before it is recirculated from the water treatment station back to the ware cleaning appliance. Instead or at the same time, the treatment of the water may also involve a pump arrangement with a plurality of pumps distributing the water to a plurality of ware cleaning appliances and/or to various wash zones and/or various rinse zones of one or more ware cleaning appliances.

The ware washing installation according to the invention, described below with reference to FIG. 1, is optimized by means of a multiplicity of the features mentioned above.

FIG. 1 shows a ware washing installation with a ware cleaning appliance 2 and with a water treatment station 4 separated spatially from the latter. The water treatment station 4 is preferably arranged at least one storey lower than the ware cleaning appliance 2. As a result, water can flow out from the ware cleaning appliance 2 to the water treatment station 4 due to gravity, without a pump being required for this purpose. The storeys may be separated from one another by means of a building ceiling 6 or a false floor. The ware cleaning appliance 2 and the water treatment station 4 together form a conveyor-type ware washer in the form of a rack-conveyor ware washer or preferably, according to FIG. 1, in the form of a flight-type ware washer.

The ware cleaning appliance 2 contains at least one wash zone and, thereafter, at least one rinse zone. As an example, the ware cleaning appliance 2 shown in FIG. 1 has successively in the ware conveying direction 65 a first ware wash zone 8, a second ware wash zone 10, a third ware wash zone 12, a first rinse zone 14 and a second rinse zone 16. Ware is transported through the said zones 8 to 16 by an endless conveyor belt 18. Located in the zones 8 to 16 are nozzles for the spraying of water onto the ware, for example, above the conveyor belt 18, upper spray nozzles 20 in the wash zones 8, 10 and 12 and upper spray nozzles 21, 22, 23 in the rinse zones 14 and 16, and lower nozzles 28, arranged between the upper strand 24 and the lower strand 26 of the conveyor belt 18, in the wash zones 8, 10 and 12 and lower nozzles 29, 30, 31 in the rinse zones 14 and 16.

Located in each of the zones is a water-collecting floor 32, in each case with at least one water discharge orifice 34 in each of the wash zones 8, 10 and 12 and with a water discharge orifice 36 in the first rinse zone 14, the sprayed rinse water from both rinse zones 14 and 16 flowing out to the water discharge orifice 36 due to gravity by means of correspondingly obliquely configured zone floors.

All the abovementioned nozzles in the wash zones 8, 10 and 12 and in the rinse zones 14 and 16 direct the water sprayed by them towards the ware to be washed and the ware to be rinsed respectively.

A fresh-water supply line 40 for fresh water, preferably heated fresh water, can issue, according to FIG. 1, into one of the two rinse zones 14, 16, preferably into the first rinse zone 14, or into a rinse-water return line 42 connected to the water discharge orifice 36 of this first rinse zone 14, or into a first rinse-water storage tank 44. A valve arrangement 46 arranged in the fresh-water supply line 40 may be situated at the location of the ware cleaning appliance 2 or preferably at the location of the water treatment station 4.

A water feed line 48 for the supply of demineralized water (or, according to another embodiment, for the supply of fresh water), contains a valve arrangement 50 and is connected to a heat exchanger line 51 which extends over the upper spray nozzles 21, 22, 23 through both rinse zones 14 and 16, so that the demineralized water flowing through it is heated by the steam rising in the rinse zones 14 and 16. The demineralized water flows, downstream of the heat exchanger line 51, through a heating device 52 in the form of electrical heating or of a heat exchanger (also referred to as a booster) and is heated therein before it is sprayed onto the washed ware by the lower and upper spray nozzles 31 and 23 of the second (last) rinse zone 16.

The valve arrangement 50 of the water feed line 48 may be situated at the location of the ware cleaning appliance 2 or preferably at the location of the water treatment station 4.

A second rinse-water storage tank 56 receives rinse water from the first rinse-water storage tank 44 via a diaphragm filter 58 by means of gravity (or a pump). The second rinse-water storage tank 56 has a water overflow 60, from which overflowing water can flow back into the first rinse-water storage tank 44 through an overflow line 63.

A first rinse-water pump arrangement 62 is connected, in the water treatment station 4, with its suction side to a water outlet 64 of the first rinse-water storage tank 44 and is connected with its delivery side to the upstream start of a forward-flow line 66, the downstream end of which is connected, in the conveying direction 65 of the ware, to the first lower and upper spray nozzles 29 and 21 of the first rinse zone 14.

The first rinse-water pump arrangement 62 preferably consists of an operating pump 67, which has a conveying capacity sufficient for conveying the rinse water through the forward-flow line 66, and of a reserve pump 68 which is connected in parallel to the said operating pump and can be selectively switched on and which likewise has a conveying capacity sufficient for conveying the rinse water through the forward-flow line 66 and as a result, in the event of a failure of the operating pump 67, can fully assume the function of the latter.

A second forward-flow line 70 is connected at its upstream end to the delivery side of a second rinse-water pump arrangement 72, the suction side of which is connected to an outlet 74 of the second rinse-water storage tank 56. The second forward-flow line 70 is connected at its downstream end, via a heating device 76, to the lower 30 and the upper 22 spray nozzles which are arranged, in the ware conveying direction 65, between the first and last spray nozzles 21, 29, 23 and 31 of the two rinse zones 14 and 16. The heating device 76 may be a heat exchanger or an electrical heating body (booster).

The two heating devices 52 and 76 of the two rinse zones 14 and 16 are preferably arranged in the ware cleaning appliance 2 in order to avoid heat losses, but, according to another embodiment, may also be arranged in the water treatment station 4.

The second rinse-water pump arrangement 72 may consist of a single pump, but, according to the preferred embodiment, consists of an operating pump 77 and of a reserve pump 78 which is connected in parallel to the latter and which can be selectively switched on if the operating pump 77 fails because of a defect or on account of maintenance work. The operating pump 77 and the reserve pump 78 in each case have a capacity sufficient for conveying the rinse water.

The first rinse-water storage tank 44 preferably has a water overflow 80, from which water can flow through an overflow line 83 into a second wash-water storage tank 84.

Fresh water, preferably hot water, can be supplied to the second wash-water storage tank 84 via a valve arrangement 86 and a fresh-water feed line 88.

An outlet 90 of the second wash-water storage tank 84 is connected via a second wash-water pump arrangement 92 to the upstream end of a forward-flow line 94 which, downstream of a branch point 96, is flow-connected, via forward-flow line branches 98-1, 98-2, 98-3 and 98-4 parallel to one another, to the upper and lower spray nozzles 20 and 28 of the wash zones 10 and 12.

The branch point 96 of the forward-flow line 94 could be arranged, instead of in the ware cleaning appliance 2, in the water treatment station 4 directly on the delivery side of the second wash-water pump arrangement 92.

The second wash-water pump arrangement 92 preferably contains two operating pumps 102 and 104 which are connected in parallel to one another and each of which has sufficient capacity to supply one of the two wash zones 10 and 12 with wash water. Preferably, a reserve pump 106 is connected in parallel to the two operating pumps 102 and 104 and can be selectively switched on if one of the operating pumps 102 or 104 fails. The reserve pump 106 has the same pump capacity as one of the other two pumps.

A wash-water line 108, the purpose of which is described later, is connected to the forward-flow line 94 of the second wash-water storage tank 2 between the delivery side of the second wash-water pump arrangement 92 and the distributor or branch point 96.

The second wash-water storage tank 84 has a water overflow device 120, from which water can flow out of the second wash-water storage tank 84 via an overflow line 122 into a first wash-water storage tank 124 which is provided with an overflow device 130, via which water can flow off through an overflow line 132. The first wash-water storage tank 124 is preferably provided with an emptying outflow 134.

If required, fresh water, preferably hot water, can be supplied to the first wash-water storage tank 124 via a valve arrangement 136 of a fresh-water feed line 138.

An outlet 140 of the first wash-water storage tank 124 is connected via a first wash-water pump arrangement 142 to the upstream end of a forward-flow line 146 which is divided, at a branch point 148, into two forward-flow line branches 146-1 and 146-2 which are parallel to one another and are connected respectively to the upper spray nozzles 20 and the lower spray nozzles 28 of the first wash zone 8. The branch point 148 may be arranged, according to FIG. 1, in the ware cleaning appliance 2 or, according to an embodiment not shown, in the water treatment station 4 on the delivery side of the first wash-water pump arrangement 142.

The first wash-water pump arrangement 142 preferably consists of an operating pump 152 and of a reserve pump 154 connected in parallel to the latter and capable of being selectively switched on. Both pumps 152 and 154 are designed for the conveying capacity required for conveying the wash water into the first wash zone 8, so that, in the event of a failure of the operating pump 152 in the case of a defect or during maintenance work, the reserve pump 154 can be switched on instead, so that, even in such a situation, the wash process in the wash zone 8 can be maintained unchanged.

The water discharge orifice 34 of the first wash zone 8 is flow-connected to a first screening device 170 via a return line 172. The wash water purified by the first screening device 170 flows into the first wash-water storage tank 124.

The water discharge orifices 34 of the second and third wash zones 10 and 12 are flow-connected to a second screening device 170 in each case via a return line 160 and 162 which can be connected to one another to form a common return line 164, soil being retained by the screen, and the wash water flowing downstream of the screening device into the second wash-water storage tank 84.

The screening devices 170 and 174 are preferably rotary screening devices which have a rotating screening cylinder 176 and 178 resp., into the interior of which the wash water of the return line 172 and 164, resp. is conducted. Wash water from the wash-water line 108 is conducted through the screening cylinders 176 and 178 from the outside inwards. In the screening cylinders 176 and 178 is located preferably a conveying element, preferably a worm 180 and 182, for the discontinuous or preferably continuous discharge of solids from the wash water which is located in the screening cylinder. The discharged solids are designated in FIG. 1 by 184 and 186 and are illustrated diagrammatically by an arrow.

A heating source 190, for example a heat exchanger or an electrical heating body, is preferably located in each case in the first rinse-water storage tank 44, the second wash-water storage tank 84 and/or the first wash-water storage tank 124.

The preferred embodiment of the invention, which is shown in FIG. 1, contains the following recirculation circuits: a first recirculation circuit, into which are integrated the forward-flow line 146 and the forward-flow line sections 146-1, 146-2, furthermore the return line 172, the first screening device 170, the first wash-water storage tank 124 and the first wash-water pump arrangement 142. Furthermore, a second recirculation circuit is provided, which contains the forward-flow lines or forward-flow line branches 94, 98-1, 98-2, 98-3, 98-4, the return lines 160, 162, 164, the second screening device 174, the second wash-water storage tank 84 and the second wash-water pump arrangement 92. A third recirculation circuit contains the forward-flow line 66, the return line 42, the first rinse-water storage tank 44 and the first rinse-water pump arrangement 62. The fourth recirculation circuit, the last in the conveying direction 65 of the ware, contains the forward-flow line 70, again the return line 42 and again the first rinse-water storage tank 44, the diaphragm filter 58, the second rinse-water storage tank 56 and the second rinse-water pump arrangement 72.

A particular advantage of the invention is that not only one ware cleaning appliance 2 can be connected to the water treatment station 4, but two or more ware cleaning appliances 2 can be connected to the single water treatment station 4. This may take place via additional forward-flow lines and return lines, which are flow-connected to the storage tanks 124, 84, 44 and 56 described and/or to the screening devices 170 and 174 described, or via parallel branches of the forward-flow lines described and of the return lines described, using the pump arrangements 72, 62, 92 and 142 already described. For this purpose, only valves or other shut-off elements 202, 204, 206, 208, 210, 212, 214, 216, 218 or 220 are required in each case in the forward-flow lines and in the parallel branches. Each of these ware cleaning appliances 2 forms, together with the common water treatment station 4, a specific conveyor-type ware washer.

According to an embodiment of the invention with a water treatment station 4 and with a plurality of ware cleaning appliances 2 connected to it, the water treatment station 4 has, for each ware cleaning appliance 2, a specific pump or pump group according to the pump arrangements 72, 62, 92 and 142 described. According to another preferred embodiment of the invention, the respective forward-flow lines of all the ware washing appliances 2 are connected to the pump arrangements 72, 62, 92 or 142 described with reference to FIG. 1, so that, in the way mentioned, each pump arrangement requires only a single reserve pump, irrespective of how many ware cleaning appliances 2 are connected to the common water treatment station 4. According to the preferred embodiment, each pump arrangement contains at least as many operating pumps 77, 67, 102 and 152 as there are ware cleaning appliances 2 provided, so that, in the event of a failure of such a pump, only one of these ware cleaning appliances 2 is affected, and this affected ware cleaning appliance can continue to be operated by means of the reserve pump 78, 68, 106, 154 of the respective pump arrangement. This means that, if only one ware cleaning appliance 2 is present, each pump arrangement contains at least one operating pump and a reserve pump; that, if two ware cleaning appliances 2 are present, each pump arrangement contains at least two operating pumps and a reserve pump; that, if three ware cleaning appliances 2 are used, each pump arrangement contains three operating pumps and a reserve pump; and so on and so forth. As a result, the pump capacity necessary for the reserve situation is reduced to a single reserve pump in each pump arrangement. Two or more reserve pumps may also be connected in parallel to an operating pump or a group of operating pumps and be capable of being selectively cut in.

The invention relates particularly to commercial ware washing installations.

The patent claims relate to examples of preferred embodiments of the invention. However, the invention also relates to the use of each individual feature and of subcombinations of features which are disclosed in the patent claims, the description and/or the drawings.

The inventive idea of positioning additional spray nozzles 22, 30 in wash ware conveying direction between the spray nozzles 21, 29 of the first rinse zone 14 and the spray nozzles 23, 31 of the final rinse zone 16, and feeding rinse water, which was pre-used and thereafter cleaned by a membrane filter 58 of FIG. 1 or by another microfiltration device 358 or an ultrafiltration device 358 of FIG. 2, can be used for conveyor-type ware washers which have a water treatment station 4 spatially separated from a ware cleaning appliance 2 as well as for conveyor ware washers which have the elements of the water treatment station 4 integrated or incorporated into the ware cleaning appliance 2. The at least one ultrafilterelement of a ultrafiltration device 358 has a pore size smaller than 0,1 μm. The at least one microfilterelement of a microfiltration device 358 has a pore size greater than 0,1 μm up to 100 μm. The filterelement may be a membrane, a ceramic element or an element of another suitable material. The invention may be used at least for the following embodiments.

EMBODIMENT 1

Ware washing installation, containing at least one conveyor-type ware washer in the form of a flight-type ware washer or a rack-conveyor ware washer, the conveyor-type ware washer containing at least one wash zone 8, 10, 12 with spray nozzles 20, 28 for spraying wash water onto the wash ware; a first rinse zone 14 with spray nozzles 21, 29 for spraying rinse water onto the wash ware; a final rinse zone 16 with spray nozzles 23, 31 for spraying final rinse water onto the wash ware; a conveyor device (18) for conveying wash ware through the zones 8, 10, 12, 14, 16; characterized by additional spray nozzles 22, 30 which are arranged between the spray nozzles 21, 29 of the first rinse zone 14 and the spray nozzles 23, 31 of the final rinse zone 16 in the ware conveying direction 65, for spraying rinse water onto the wash ware; a rinse-water storage tank 44 for receiving the final rinse water sprayed by the spray nozzles 23, 31 of the final rinse zone 16, for receiving the rinse water sprayed by the additional spray nozzles 22, 30 and for receiving the rinse water sprayed by the spray nozzles 21, 29 of the first rinse zone 14; a rinse-water forward path 62, 66 with at least one pump 67, 68 from the rinse-water storage tank 44 to the spray nozzles 21, 29 of the first rinse zone 14, in order to supply rinse water from the rinse-water storage tank 44 to the spray nozzles 21, 29, so that a rinse-water recirculation circuit from the rinse-water storage tank 44 to the spray nozzles 21, 29 of the first rinse zone 14 and then back again into the rinse-water storage tank 44 is formed; an additional rinse-water forward path 58, 56, 72, 70, 76; 358, 56, 72, 70, 76 with a microfiltration device and/or an ultrafiltration device 58; 358 for cleaning the rinse water and with at least one pump 77, 78 from the rinse-water storage tank 44 to the additional spray nozzles 22, 30, in order to supply cleaned water from the rinse-water storage tank (44) to the additional spray nozzles 22, 30, so that an additional rinse-water recirculation circuit from the rinse-water storage tank 44 to the additional spray nozzles 22, 30 and then back again into the rinse-water storage tank 44 is formed.

EMBODIMENT 2

Ware washing installation according to Embodiment 1, characterized in that the filtration device 58; 358 has a membrane as a microfiltration element or as an ultrafiltration element for filtering the rinse water on the way from the rinse-water storage tank 44 to the additional spray nozzles 22, 30.

EMBODIMENT 3

Ware washing installation according to at least one of the preceding embodiments, characterized in that an additional rinse-water storage tank 56 is arranged in the additional rinse-water forward path 58, 56, 72, 70, 76; 358, 56, 72, 70, 76 between the filtration device (58; 358) and the pump 77, 78.

EMBODIMENT 4

Ware washing installation according to embodiment 3, characterized in that the additional rinse-water storage tank 56 has an overflow 60, via which rinse water can flow back into the rinse-water storage tank 44.

EMBODIMENT 5

Ware washing installation according to at least one of the preceding claims, characterized in that, in the additional rinse-water forward path 58, 56, 72, 70, 76; 358, 56, 72, 70, 76, a heating device 76 for heating the rinse water is arranged downstream of the pump 77, 78.

EMBODIMENT 6

Ware washing installation according to at least one of the preceding embodiments, characterized in that at least one wash-water storage tank 84, 124 for receiving the wash water sprayed by the spray nozzles 20, 28 of at least one of the wash zones 8, 10, 12 is provided; in that at least one wash-water forward line string 92, 94; 142, 146 with at least one pump 102, 104, 106; 152, 154 from the at least one wash-water storage tank 84, 214 to the spray nozzles 20, 28 of the at least one wash zone 8, 10, 12 is provided, in order to supply wash water from the wash-water storage tank 84, 124 to the spray nozzles 20, 28, so that at least one wash-water recirculation circuit from the wash-water storage tank 84, 124 to the spray nozzles 20, 28 of the respective wash zone 8, 10, 12 and back again to the wash-water storage tank 84, 124 is formed.

EMBODIMENT 7

Ware washing installation according to embodiment 6, characterized in that the rinse-water storage tank 44 and the at least one wash-water storage tank 84, 124 are provided in each case with a water overflow 80, 120, by means of which water can flow from storage tank to storage tank opposite to the ware conveying direction 65, starting from the rinse-water storage tank 44 and going to the wash-water storage tank 120 which is the last wash-water storage tank in the ware conveying direction 65.

EMBODIMENT 8

Ware washing installation according to at least one of the preceding embodiments, characterized in that the filtration device 58; 358 comprises a cross-flow filter which is provided with at least one primary chamber 302 and at least one secondary chamber 304 which are separated from one another by at least one microfilter element or ultrafilter element 306, the primary chamber 302 having an inlet 308 and an outlet 310 for rinse water to be cleaned, and the secondary chamber 304 having an outlet 312 for the filtered and thereby cleaned part of the rinse water.

EMBODIMENT 9

Ware washing installation according to embodiment 8, characterized in that a return line 316 from the outlet 310 of the primary chamber 302 of the cross-flow filter 358 to a storage tank is provided, in order to re-use the unfiltered rinse water fraction from the outlet 310 of the primary chamber 302 in the ware washing installation again.

EMBODIMENT 10

Ware washing installation according to embodiment 9, characterized in that the return line 316 is arranged in such a way that the unfiltered rinse water fraction from the outlet 310 of the primary chamber 302 in the cross-flow filter 358 is led back into the rinse-water storage tank 44.

The invention claimed is:

1. Ware washing installation, containing at least one conveyor-type ware washer in the form of a flight-type ware washer or a rack-conveyor ware washer, the conveyor-type ware washer containing at least one wash zone with spray nozzles for spraying wash water onto the wash ware; a first rinse zone with spray nozzles for spraying rinse water onto the wash ware; a final rinse zone with spray nozzles for spraying final rinse water onto the wash ware; a conveyor device for conveying wash ware through the zones; characterized by additional spray nozzles which are arranged between the spray nozzles of the first rinse zone and the spray nozzles of the final rinse zone in the ware conveying direction, for spraying rinse water onto the wash ware; a rinse-water storage tank for receiving the final rinse water sprayed by the spray nozzles of the final rinse zone, for receiving the rinse water sprayed by the additional spray nozzles and for receiving the rinse water sprayed by the spray nozzles of the first rinse zone; a rinse-water forward path with at least one pump from the rinse-water storage tank to the spray nozzles of the first rinse zone, in order to supply rinse water from the rinse-water storage tank to the spray nozzles, so that a rinse-water recirculation circuit from the rinse-water storage tank to the spray nozzles of the first rinse zone and then back again into the rinse-water storage tank is formed; an additional rinse-water forward path with a microfiltration device and/or an ultrafiltration device for cleaning the rinse water and with at least one pump from the rinse-water storage tank to the additional spray nozzles, in order to supply cleaned water from the rinse-water storage tank to the additional spray nozzles, so that an additional rinse-water recirculation circuit from the rinse-water storage tank to the additional spray nozzles and then back again into the rinse-water storage tank is formed.

2. Ware washing installation according to claim 1, characterized in that the filtration device has a membrane as a microfiltration element or as an ultrafiltration element for filtering the rinse water on the way from the rinse-water storage tank to the additional spray nozzles.

3. Ware washing installation according to at least one of the preceding claims, characterized in that an additional rinse-water storage tank is arranged in the additional rinse-water forward path between the filtration device and the pump.

4. Ware washing installation according to Claim 3, characterized in that the additional rinse-water storage tank has an overflow, via which rinse water can flow back into the rinse-water storage tank.

5. Ware washing installation according to Claim 1, characterized in that, in the additional rinse-water forward path, a heating device for heating the rinse water is arranged downstream of the pump.

6. Ware washing installation according to Claim 1, characterized in that at least one wash-water storage tank for receiving the wash water sprayed by the spray nozzles of at least one of the wash zones is provided; in that at least one wash-water forward line string with at least one pump from the at least one wash-water storage tank to the spray nozzles of the at least one wash zone is provided, in order to supply wash water from the wash-water storage tank to the spray nozzles, so that at least one wash-water recirculation circuit from the wash-water storage tank to the spray nozzles of the respective wash zone and back again to the wash-water storage tank is formed.

7. Ware washing installation according to Claim 6, characterized in that the rinse-water storage tank and the at least one wash-water storage tank are provided in each case with a water overflow , by means of which water can flow from storage tank to storage tank opposite to the ware conveying direction , starting from the rinse-water storage tank and going to the wash-water storage tank which is the last wash-water storage tank in the ware conveying direction.

8. Ware washing installation according to Claim 1, characterized in that the filtration device comprises a cross-flow filter which is provided with at least one primary chamber and at least one secondary chamber which are separated from one another by at least one microfilter element or ultrafilter element , the primary chamber having an inlet and an outlet for rinse water to be cleaned, and the secondary chamber having an outlet for the filtered and thereby cleaned part of the rinse water.

9. Ware washing installation according to Claim 8, characterized in that a return line from the outlet of the primary chamber of the cross-flow filter to a storage tank is provided, in order to re-use the unfiltered rinse water fraction from the outlet of the primary chamber in the ware washing installation again.

10. Ware washing installation according to Claim 9, characterized in that the return line is arranged in such a way that the unfiltered rinse water fraction from the outlet of the primary chamber in the cross-flow filter is led back into the rinse-water storage tank.

* * * * *